US010553201B2

(12) United States Patent
Zhou

(10) Patent No.: US 10,553,201 B2
(45) Date of Patent: Feb. 4, 2020

(54) METHOD AND APPARATUS FOR SPEECH SYNTHESIS

(71) Applicant: BEIJING BAIDU NETCOM SCIENCE AND TECHNOLOGY CO., LTD., Beijing (CN)

(72) Inventor: Zhiping Zhou, Beijing (CN)

(73) Assignee: BEIJING BAIDU NETCOM SCIENCE AND TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 16/134,893

(22) Filed: Sep. 18, 2018

(65) Prior Publication Data

US 2019/0164535 A1 May 30, 2019

(30) Foreign Application Priority Data

Nov. 27, 2017 (CN) ..... 2017 1 1205386

(51) Int. Cl.

| | |
|---|---|
| ***G10L 13/00*** | (2006.01) |
| ***G10L 13/08*** | (2013.01) |
| ***G10L 13/06*** | (2013.01) |
| ***G10L 13/047*** | (2013.01) |

(52) U.S. Cl.

CPC ..... *G10L 13/08* (2013.01); *G10L 13/047* (2013.01); *G10L 13/06* (2013.01)

(58) Field of Classification Search

CPC ..... G10L 13/08; G10L 13/06; G10L 13/047

USPC ..... 704/259

See application file for complete search history.

(56) References Cited

U.S. PATENT DOCUMENTS

2016/0140953 A1* 5/2016 Kwon ..... G10L 13/047 704/260

2018/0174570 A1* 6/2018 Tamura ..... G10L 13/0335

* cited by examiner

*Primary Examiner* — Thierry L Pham

(74) *Attorney, Agent, or Firm* — Marshall, Gerstein & Borun LLP

(57) ABSTRACT

A method of speech synthesis is provided, which comprises: determining a phoneme sequence of a to-be-processed text; inputting the phoneme sequence into a pre-trained speech model to obtain an acoustic characteristic corresponding to each phoneme in the phoneme sequence, where the speech model is used for characterizing a corresponding relationship between each phoneme in the phoneme sequence and the acoustic characteristic; determining, for each phoneme in the phoneme sequence, at least one speech waveform unit corresponding to each phoneme based on a preset index of phonemes and speech waveform units, and determining a target speech waveform unit of the at least one speech waveform unit based on the acoustic characteristic corresponding to the phoneme and a preset cost function; and synthesizing the target speech waveform unit corresponding to each phoneme in the phoneme sequence to generate a speech.

13 Claims, 4 Drawing Sheets

METHOD AND APPARATUS FOR SPEECH SYNTHESIS

CROSS-REFERENCE TO RELATED APPLICATIONS

This application claims priority to Chinese Patent Application No. 201711205386.X, filed on Nov. 27, 2017, titled "Method and Apparatus for Speech Synthesis," which is hereby incorporated by reference in its entirety.

TECHNICAL FIELD

Embodiments of the disclosure relate to the field of computer technology, specifically to the field of Internet technology, and more specifically to a method and apparatus for speech synthesis.

BACKGROUND

Artificial intelligence (AI) is a novel technological science that researches and develops theories, methods, techniques and applications for simulating, extending and expanding human intelligence. Artificial intelligence is a branch of the computer science that attempts to understand the essence of intelligence and produces novel intelligent machinery capable of responding in a way similar to human intelligence. Researches in the field include robots, speech recognition, image recognition, natural language processing, expert systems, and the like. The speech synthesis is a technique that electronically or mechanically generates a constructed speech. As a branch of the speech synthesis, the text-to-speech (TTS) technology is a technology that converts a computer-generated or externally entered text message into an understandable and fluent spoken language, and outputs the spoken language.

The existing speech synthesis method usually outputs an acoustic characteristic corresponding to a text using a speech model based on the hidden markov model (HMM), and then converts parameters into speech by a vocoder.

SUMMARY

A method and an apparatus for speech synthesis are provided according to the embodiments of the disclosure.

In a first aspect, a method for speech synthesis is provided according to an embodiment of the disclosure. The method includes: determining a phoneme sequence of a to-be-processed text; inputting the phoneme sequence into a pre-trained speech model to obtain an acoustic characteristic corresponding to each phoneme in the phoneme sequence, where the speech model is used for characterizing a corresponding relationship between each phoneme in the phoneme sequence and the acoustic characteristic; determining, for each phoneme in the phoneme sequence, at least one speech waveform unit corresponding to the phoneme based on a preset index of phonemes and speech waveform units, and determining a target speech waveform unit of the at least one speech waveform unit based on the acoustic characteristic corresponding to the phoneme and a preset cost function; and synthesizing the target speech waveform unit corresponding to each phoneme in the phoneme sequence to generate a speech.

In some embodiments, the speech model is an end-to-end neural network. The end-to-end neural network includes a first neural network, an attention model and a second neural network.

In some embodiments, the speech model is obtained by following training: extracting a training sample, the training sample including a text sample and a speech sample corresponding to the text sample; determining a phoneme sequence sample of the text sample and a speech waveform unit forming the speech sample, and extracting an acoustic characteristic from the speech waveform unit forming the speech sample; and training, using a machine learning method, with the phoneme sequence sample as an input and the extracted acoustic characteristic as an output, to obtain the speech model.

In some embodiments, the preset index of phonemes and speech waveform units is obtained by following: determining, for each phoneme in the phoneme sequence sample, a speech waveform unit corresponding to the phoneme based on the acoustic characteristic corresponding to the phoneme; and establishing the index of phonemes and speech waveform units based on a corresponding relationship between each phoneme in the phoneme sequence sample and the speech waveform unit.

In some embodiments, the cost function includes a target cost function and a connection cost function, the target cost function is used for characterizing a matching degree between the speech waveform unit and the acoustic characteristic, and the connection cost function is used for characterizing a continuity of adjacent speech waveform units.

In some embodiments, the determining, for each phoneme in the phoneme sequence, at least one speech waveform unit corresponding to the phoneme based on the preset index of phonemes and speech waveform units, and determining a target speech waveform unit of the at least one speech waveform unit based on the acoustic characteristic corresponding to the phoneme and a preset cost function includes: determining, for each phoneme in the phoneme sequence, at least one speech waveform unit corresponding to the phoneme based on the preset index of phonemes and speech waveform units; using the acoustic characteristic corresponding to the phoneme as a target acoustic characteristic, extracting, for each speech waveform unit of the at least one speech waveform unit, an acoustic characteristic of the speech waveform unit, and determining a value of the target cost function based on the extracted acoustic characteristic and the target acoustic characteristic; and determining the speech waveform unit corresponding to the value of the target function meeting a preset condition as a candidate speech waveform unit corresponding to the phoneme; and determining a target speech waveform unit among the candidate speech waveform unit corresponding to each phoneme in the phoneme sequence using a viterbi algorithm based on the acoustic characteristic corresponding to the determined candidate speech waveform unit and the connection cost function.

In a second aspect, an embodiment of the disclosure provides an apparatus for speech synthesis. The apparatus includes: a first determining unit, configured for determining a phoneme sequence of a to-be-processed text; an inputting unit, configured for inputting the phoneme sequence into a pre-trained speech model to obtain an acoustic characteristic corresponding to each phoneme in the phoneme sequence, wherein the speech model is used for characterizing a corresponding relationship between each phoneme in the phoneme sequence and the acoustic characteristic; a second determining unit, configured for determining, for each phoneme in the phoneme sequence, at least one speech waveform unit corresponding to the phoneme based on a preset index of phonemes and speech waveform units, and determining a target speech waveform unit of the at least one speech waveform unit based on the acoustic characteristic corresponding to the phoneme and a preset cost function; and a synthesizing unit, configured for synthesizing the target speech waveform unit corresponding to each phoneme in the phoneme sequence to generate a speech.

In some embodiments, the speech model is an end-to-end neural network. The end-to-end neural network includes a first neural network, an attention model and a second neural network.

In some embodiments, the apparatus further includes: an extracting unit, configured for extracting a training sample, the training sample including a text sample and a speech sample corresponding to the text sample; a third determining unit, configured for determining a phoneme sequence sample of the text sample and a speech waveform unit forming the speech sample, and extracting an acoustic characteristic from the speech waveform unit forming the speech sample; and a training unit, configured for training, using a machine learning method, with the phoneme sequence sample as an input and the extracted acoustic characteristic as an output, to obtain the speech model.

In some embodiments, the apparatus further includes: a fourth determining unit, configured for determining, for each phoneme in the phoneme sequence sample, a speech waveform unit corresponding to the phoneme based on the acoustic characteristic corresponding to the phoneme; and an establishing unit, configured for establishing the index of phonemes and speech waveform units based on a corresponding relationship between each phoneme in the phoneme sequence sample and the speech waveform unit.

In some embodiments, the cost function includes a target cost function and a connection cost function, the target cost function is used for characterizing a matching degree between the speech waveform unit and the acoustic characteristic, and the connection cost function is used for characterizing a continuity of adjacent speech waveform units.

In some embodiments, the second determining unit includes: a first determining module, configured for determining, for each phoneme in the phoneme sequence, at least one speech waveform unit corresponding to the phoneme based on the preset index of phonemes and speech waveform units; using the acoustic characteristic corresponding to the phoneme as a target acoustic characteristic, extracting, for each speech waveform unit of the at least one speech waveform unit, an acoustic characteristic of the speech waveform unit, and determining a value of the target cost function based on the extracted acoustic characteristic and the target acoustic characteristic; and determining the speech waveform unit corresponding to the value of the target function meeting a preset condition as a candidate speech waveform unit corresponding to the phoneme; and a second determining module, configured for determining a target speech waveform unit among the candidate speech waveform unit corresponding to each phoneme in the phoneme sequence using a viterbi algorithm based on the acoustic characteristic corresponding to the determined candidate speech waveform unit and the connection cost function.

In a third aspect, an embodiment of the disclosure provides an electronic device, including: one or more processors; and a memory for storing one or more programs, where the one or more programs enable, when executed by the one or more processors, the one or more processors to implement the method according to any one embodiment of the method for speech synthesis.

In a fourth aspect, an embodiment of the disclosure provides a computer readable storage medium storing a computer program therein, where the program implements, when executed by a processor, the method according to any one embodiment of the method for speech synthesis.

The method and apparatus for speech synthesis provided by embodiments of the disclosure input a phoneme sequence of a to-be-processed text into a pre-trained speech model to obtain an acoustic characteristic corresponding to each phoneme in the phoneme sequence, then determine at least one speech waveform unit corresponding to each phoneme based on a preset index of phonemes and speech waveform units, determine a target speech waveform unit corresponding to the phoneme based on the acoustic characteristic corresponding to the phoneme and a preset cost function, and finally synthesize the target speech waveform unit corresponding to each phoneme to generate a speech, thereby improving the effect and efficiency of speech synthesis without the need of converting acoustic characteristics into speeches via a vocoder, and without the need of manually aligning and segmenting phonemes and speech waveforms.

BRIEF DESCRIPTION OF THE DRAWINGS

By reading and referring to detailed description on the non-limiting embodiments in the following accompanying drawings, other features, objects and advantages of the disclosure will become more apparent.

DETAILED DESCRIPTION OF EMBODIMENTS

The present disclosure will be further described below in detail in combination with the accompanying drawings and the embodiments. It should be appreciated that the specific embodiments described herein are merely used for explaining the relevant disclosure, rather than limiting the disclosure. In addition, it should be noted that, for the ease of description, only the parts related to the relevant disclosure are shown in the accompanying drawings.

It should also be noted that the embodiments in the present disclosure and the features in the embodiments may be combined with each other on a non-conflict basis. The present disclosure will be described below in detail with reference to the accompanying drawings and in combination with the embodiments.

Figure 1:
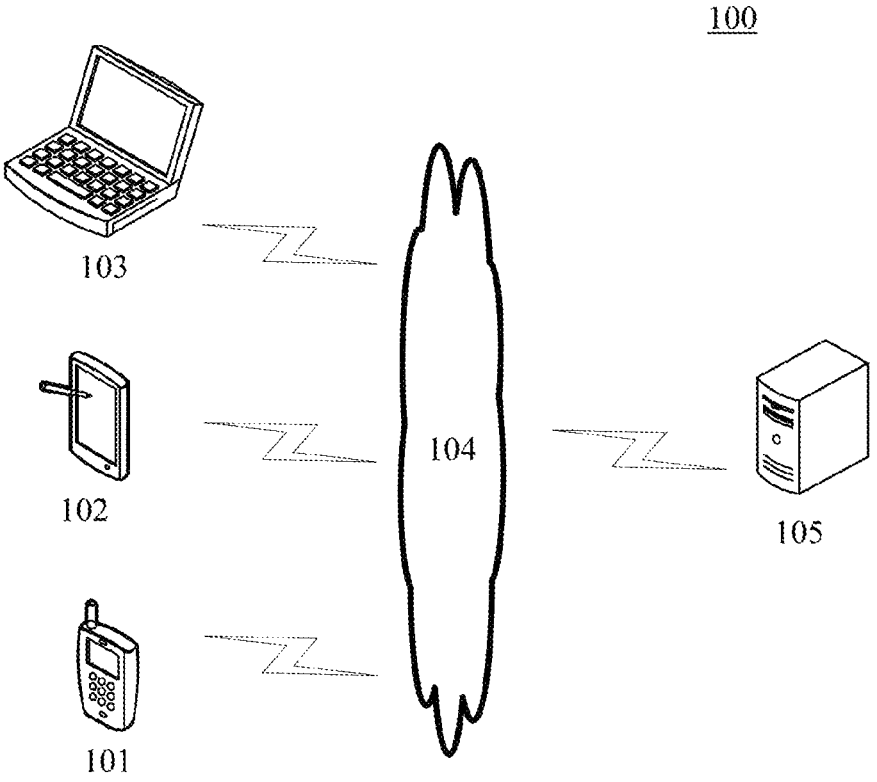
FIG. 1 is a diagram of an exemplary architecture in which the disclosure may be applied.

Reference is made to FIG. 1, which shows an exemplary system architecture 100 in which an method for speech synthesis or an apparatus for speech synthesis according to the disclosure may be applied.

As shown in FIG. 1, the system architecture 100 may include terminal devices 101, 102 and 103, a network 104 and a server 105. The network 104 serves as a medium providing a communication link between the terminal devices 101, 102 and 103 and the server 105. The network 104 may include various types of connections, such as wired or wireless transmission links, or optical fiber.

A user may interact with the server 105 using the terminal devices 101, 102 and 103 through the network 104, to receive or send messages, etc. The terminal devices 102 and 103 may be installed with a variety of communication client applications, such as a web browser application, a shopping application, a search application, an instant communication tool, a mail client, and social platform software.

The terminal devices 101, 102 and 103 may be various electronic devices having a display screen and supporting webpage browsing, including but not limited to, smart phones, tablet computers, e-book readers, MP3 (Moving Picture Experts Group Audio Layer III) players, MP4 (Moving Picture Experts Group Audio Layer IV) players, laptop computers and desktop computers.

The server 105 may be a server providing various services, for example, a speech processing server providing a TTS service for text information sent by the terminal devices 101, 102 and 103. The speech processing server may perform analysis on data such as a to-be-processed text, and return a processing result (e.g., synthesized speech) to the terminal devices.

It should be noted that the method for speech synthesis according to the embodiments of the present disclosure is generally executed by the server 105. Accordingly, the apparatus for speech synthesis is generally installed on the server 105.

It should be appreciated that the numbers of the terminal devices, the networks and the servers in FIG. 1 are merely illustrative. Any number of terminal devices, networks and servers may be provided based on the actual requirement.

Figure 2:
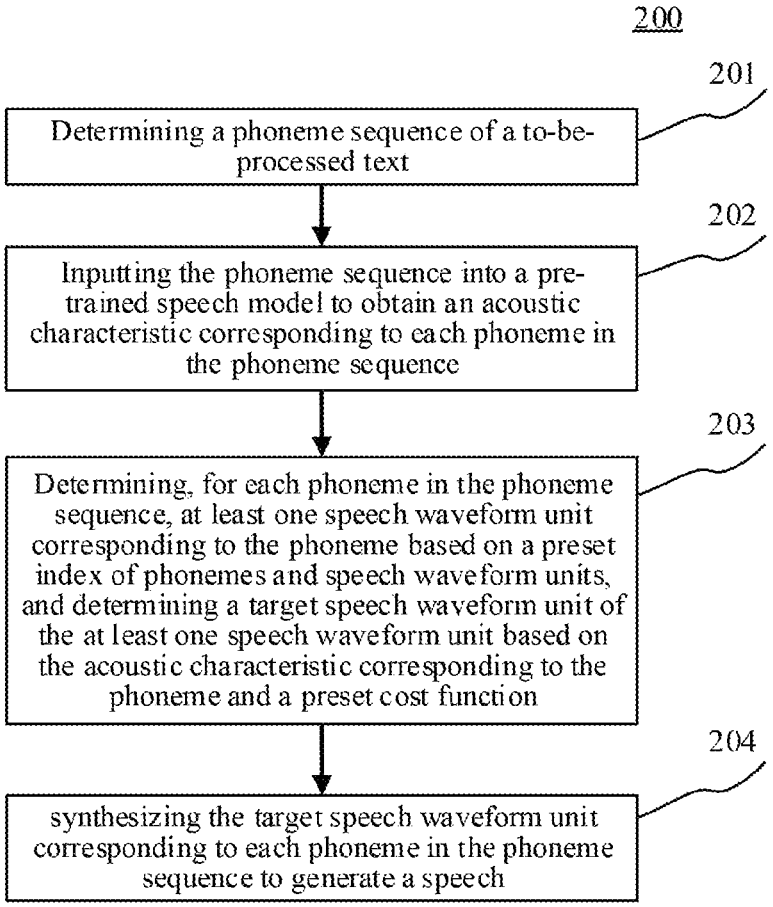
FIG. 2 is a flowchart of a method for speech synthesis according to an embodiment of the disclosure.

Reference is made to FIG. 2, which shows a flow 200 of a method for speech synthesis according to an embodiment of the disclosure. The method for speech synthesis includes steps 201 to 204.

Step 201 includes: determining a phoneme sequence of a to-be-processed text.

In the embodiment, an electronic device (e.g., the server 105 shown in FIG. 1) in which the method for speech synthesis is implemented may firstly acquire a to-be-processed text, where the to-be-processed text may include various characters (e.g., Chinese and/or English, etc.). The to-be-processed text may be pre-stored in the electronic device locally. In this case, the electronic device may directly extract the to-be-processed text locally. Furthermore, the to-be-processed text may alternatively be sent to the electronic device by a user by way of wired connection or wireless connection. It should be noted that the wireless connection may include, but is not limited to, 3G/4G connection, WiFi connection, Bluetooth connection, WiMAX connection, Zigbee connection, UWB (ultra wideband) connection, and other wireless connections that are known at present or are to be developed in the future.

Here, a corresponding relation between large amounts of characters and phonemes may be pre-stored in the electronic device. In practice, the phoneme is a smallest speech unit divided based on the natural attributes of speech. From the perspective of acoustic properties, the phoneme is a smallest speech unit divided based on the tone quality. Taking Chinese characters as an example, the Chinese syllable a (ah) includes one phoneme, ài (love) includes two phonemes, dài (dull) includes three phonemes, and so on. After acquiring the to-be-processed text, the electronic device may determine the phonemes corresponding to characters forming the to-be-processed text based on the pre-stored corresponding relationship between characters and phonemes, thereby successively combining the phonemes corresponding to the characters into a phoneme sequence.

Step 202 includes: inputting the phoneme sequence into a pre-trained speech model to obtain an acoustic characteristic corresponding to each phoneme in the phoneme sequence.

In the embodiment, the electronic device may input the phoneme sequence into a pre-trained speech model to obtain an acoustic characteristic corresponding to each phoneme in the phoneme sequence, where the acoustic characteristic may include parameters (e.g., a base frequency and a frequency spectrum) associated with a voice. The speech model may be used for characterizing a corresponding relationship between each phoneme in the phoneme sequence and an acoustic characteristic. As an example, the speech model may be a list of corresponding relationship between phonemes and acoustic characteristics pre-established based on a large amount of statistical data. As another example, the speech model may be obtained by supervised training using a machine learning method. In practice, a speech model (e.g., the hidden Markov model or an existing model structure such as deep neural network) may be obtained by training using various models.

In some optional implementations of the embodiment, the speech model may be obtained by three training steps.

The first step includes extracting a training sample, where the training sample may include a text sample (may contain various characters, such as Chinese and English) and a speech sample corresponding to the text sample.

The second step includes determining a phoneme sequence sample of the text sample and a speech waveform unit forming the speech sample, and extracting an acoustic characteristic from the speech waveform unit forming the speech sample. Specifically, the electronic device may firstly determine the phoneme sequence corresponding to the text sample in the same manner as that in the step 201, and determine the determined phoneme sequence as the phoneme sequence sample. Then, the electronic device may segment the speech waveform unit forming the speech sample using existing automatic speech segmentation technologies. Each phoneme in the phoneme sequence sample may correspond to a segmented speech waveform unit, and the number of phonemes in the phoneme sequence sample is the same as that of the segmented speech waveform units. Then, the electronic device may extract the acoustic characteristic from each segmented speech waveform unit.

The third step includes obtaining the speech model by training the above models using a machine learning method, with the phoneme sequence as an input and the extracted acoustic characteristic as an output. It should be noted that the machine learning method and the model training method are well-known techniques, which are widely researched and applied at present, and are not repeated any more here.

Step 203 includes: determining, for each phoneme in the phoneme sequence, at least one speech waveform unit corresponding to the phoneme based on a preset index of phonemes and speech waveform units, and determining a target speech waveform unit of the at least one speech waveform unit based on the acoustic characteristic corresponding to the phoneme and a preset cost function.

In the embodiment, the preset index of phonemes and speech waveform units may be stored in the electronic device. The index may be used for characterizing a corresponding relationship between phonemes and positions of speech waveform units in a speech library. Therefore, a speech waveform unit corresponding to a phoneme may be found in the speech library based on the index. A given phoneme corresponds to at least one speech waveform unit in the speech library, which usually requires further filtering. For each phoneme in the phoneme sequence, the electronic device may firstly determine at least one speech waveform unit corresponding to the phoneme based on the index of phonemes and speech waveform units. Then the electronic device may determine a target speech waveform unit of the at least one speech waveform unit based on the acoustic characteristic corresponding to the phoneme acquired in the step 202 and the preset cost function. The preset cost function may be used for characterizing a similarity degree between acoustic characteristics, and the smaller the cost function is, the more similar the acoustic characteristics are. In practice, the cost function may be pre-established using various functions for similarity degree calculation. For example, the cost function may be established based on a Euclidean distance function. In this case, the target speech waveform unit may be determined as follows: for each phoneme in the phoneme sequence, the electronic device may use the acoustic characteristic corresponding to the phoneme acquired in the step 202 as the target acoustic characteristic, extract the acoustic characteristic from each speech waveform unit corresponding to the phoneme, and calculate an Euclidean distance between the extracted acoustic characteristic and the target acoustic characteristic one by one. Then, for the phoneme, the speech waveform unit having a greatest similarity degree may be used as the target speech waveform unit of the phoneme.

Step 204 includes: synthesizing the target speech waveform unit corresponding to each phoneme in the phoneme sequence to generate a speech.

In the embodiment, the electronic device may synthesize the target speech waveform unit corresponding to each phoneme in the phoneme sequence to generate the speech. Specifically, the electronic device may synthesize the target speech waveform unit using a waveform concatenation method (e.g., Pitch Synchronous OverLap Add, PSOLA). It should be noted that the waveform concatenation method is widely researched and applied at present, and is not repeated any more here.

The method for speech synthesis according to embodiments of the disclosure inputs a phoneme sequence of a to-be-processed text into a pre-trained speech model to obtain an acoustic characteristic corresponding to each phoneme in the phoneme sequence, then determines at least one speech waveform unit corresponding to each phoneme based on a preset index of phonemes and speech waveform units, determines a target speech waveform unit corresponding to the phoneme based on the acoustic characteristic corresponding to the phoneme and a preset cost function, and finally synthesizes the target speech waveform unit corresponding to each phoneme to generate a speech, thereby improving the effect and efficiency of speech synthesis without the need of converting acoustic characteristics into speeches via a vocoder, and without the need of manually aligning and segmenting phonemes and speech waveforms.

Figure 3:
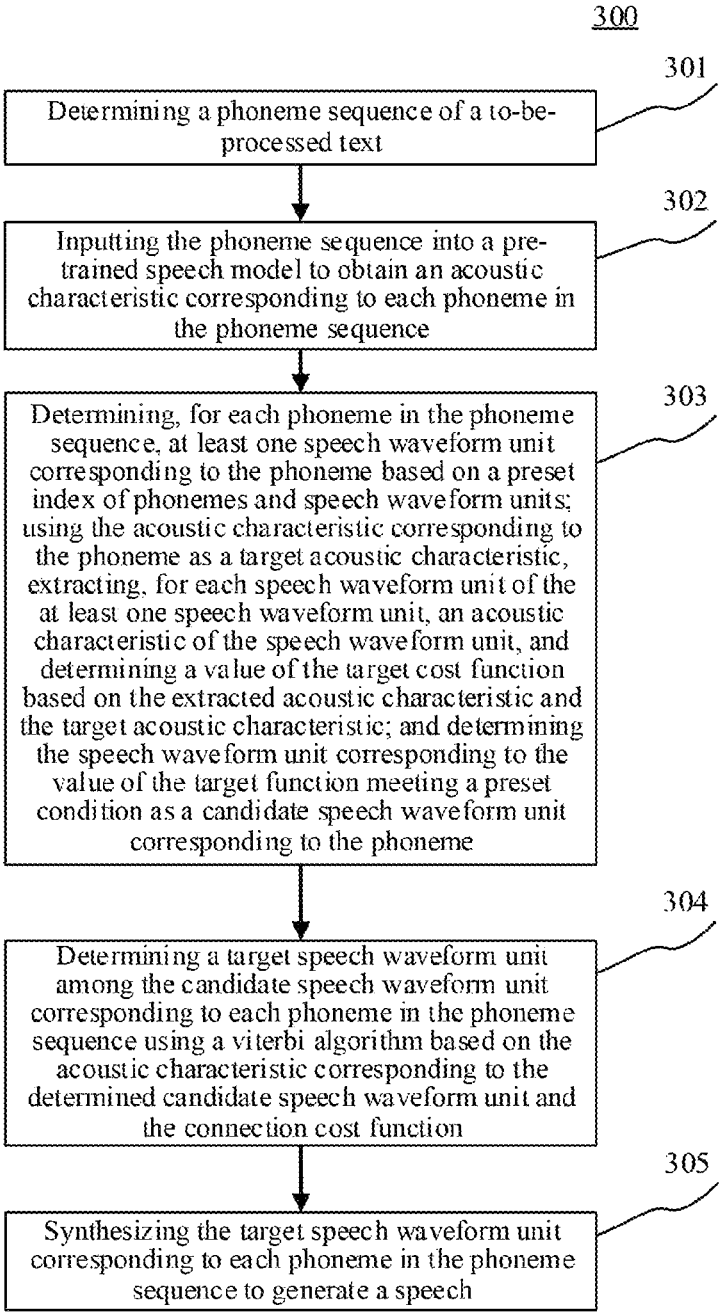
FIG. 3 is a flowchart of a method for speech synthesis according to another embodiment of the disclosure.

Reference is made to FIG. 3, which shows a flow 300 of a method for speech synthesis according to another embodiment of the disclosure. The flow 300 of the method for speech synthesis includes steps 301 to 305.

Step 301 includes: determining a phoneme sequence of a to-be-processed text.

In the embodiment, a corresponding relationship between large amounts of characters and phonemes may be pre-stored in an electronic device (e.g., the server 105 shown in FIG. 1) in which the method for speech synthesis is implemented. The electronic device may firstly acquire the to-be-processed text, then determine the phonemes corresponding to characters forming the to-be-processed text based on the pre-stored corresponding relationship between characters and phonemes, thereby successively combining the phonemes corresponding to the characters into the phoneme sequence.

Step 302 includes: inputting the phoneme sequence into a pre-trained speech model to obtain an acoustic characteristic corresponding to each phoneme in the phoneme sequence.

In the embodiment, the electronic device may input the phoneme sequence into the pre-trained speech model to obtain the acoustic characteristic corresponding to each phoneme in the phoneme sequence, where the acoustic characteristic may include parameters (e.g., abase frequency and a frequency spectrum) associated with a voice. The speech model may be used for characterizing a corresponding relationship between each phoneme in the phoneme sequence and an acoustic characteristic.

Here, the speech model may be an end-to-end neural network. The end-to-end neural network may include a first neural network, an attention model (AM) and a second neural network. The first neural network may be used as an encoder for converting the phoneme sequence into a vector sequence, and one phoneme may correspond to one vector. An existing neural network structure, such as a multilayer long short-term memory (LSTM), a multilayer bidirectional long short-term memory (BLSTM), or a recurrent neural network (RNN), may be used as the first neural network. The attention model may be used to assign different weights to an output of the first neural network, and the weight may be a probability of the phoneme corresponding to the acoustic characteristic. The second neural network may be used as a decoder for outputting the acoustic characteristic corresponding to each phoneme in the phoneme sequence. An existing neural network structure, such as a long short-term memory, a bidirectional long short-term memory, or a recurrent neural network, may be used as the second neural network.

In the embodiment, the speech model may be obtained by three training steps.

The first step includes extracting a training sample, where the training sample may include a text sample (may contain various characters, such as Chinese and English) and a speech sample corresponding to the text sample.

The second step includes determining a phoneme sequence sample of the text sample and a speech waveform unit forming the speech sample, and extracting an acoustic characteristic from the speech waveform unit forming the speech sample. Specifically, the electronic device may firstly determine the phoneme sequence corresponding to the text sample in the same manner as that in the step 201, and determine the determined phoneme sequence as the phoneme sequence sample. Then, the electronic device may segment the speech waveform unit forming the speech sample using existing automatic speech segmentation technologies. Each phoneme in the phoneme sequence sample may correspond to a segmented speech waveform unit, and the number of phonemes in the phoneme sequence sample is the same as that of the segmented speech waveform units. Then, the electronic device may extract the acoustic characteristic from each segmented speech waveform unit.

The third step includes obtaining the speech model by training using a machine learning method, with the phoneme sequence as an input of the end-to-end neural network and the extracted acoustic characteristic as an output of the end-to-end neural network. It should be noted that the machine learning method and the model training method are well-known techniques, which are widely researched and applied at present, and are not repeated any more here.

Step 303 includes: determining, for each phoneme in the phoneme sequence, at least one speech waveform unit corresponding to the phoneme based on a preset index of phonemes and speech waveform units; using the acoustic characteristic corresponding to the phoneme as a target acoustic characteristic, extracting, for each speech waveform unit of the at least one speech waveform unit, an acoustic characteristic of the speech waveform unit, and determining a value of the target cost function based on the extracted acoustic characteristic and the target acoustic characteristic; and determining the speech waveform unit corresponding to the value of the target function meeting a preset condition as a candidate speech waveform unit corresponding to the phoneme.

In the embodiment, a preset index of phonemes and speech waveform units may be stored in the electronic device. The index may be obtained by the electronic device based on the process of training the speech model. First, for each phoneme in the phoneme sequence sample, a speech waveform unit corresponding to the phoneme is determined based on the acoustic characteristic corresponding to the phoneme. Here, each phoneme in the phoneme sequence corresponds to an acoustic characteristic of a speech waveform unit. Therefore, the corresponding relationship between phonemes and speech waveform units may be determined based on the corresponding relationship between phonemes and acoustic characteristics. Secondly, the index of phonemes and speech waveform units may be established based on the corresponding relationship between each phoneme in the phoneme sequence sample and the speech waveform unit. The index may be used for characterizing a corresponding relationship between phonemes and speech waveform units or positions of the speech waveform units in a speech library. Therefore, a speech waveform unit corresponding to a phoneme may be found in the speech library based on the index.

In the embodiment, the cost function may be pre-stored in the electronic device. The cost function may include a target cost function and a connection cost function, the target cost function may be used for characterizing a matching degree between the speech waveform unit and the acoustic characteristic, and the connection cost function may be used for characterizing a continuity of adjacent speech waveform units. Here, both the target cost function and the connection cost function may be established based on a Euclidean distance function. The smaller the value of the target cost function is, the better the speech waveform unit matches the acoustic characteristic; and the smaller the value of the connection cost function is, the higher the continuity of adjacent speech waveform units is.

In the embodiment, for each phoneme in the phoneme sequence, the electronic device may determine at least one speech waveform unit corresponding to the phoneme based on the index; use the acoustic characteristic corresponding to the phoneme as the target acoustic characteristic; extract, for each speech waveform unit of the at least one speech waveform unit, an acoustic characteristic of the speech waveform unit, and determine a value of the target cost function based on the extracted acoustic characteristic and the target acoustic characteristic; and determine the speech waveform unit corresponding to the value of the target function meeting a preset condition as a candidate speech waveform unit corresponding to the phoneme. Here, the preset condition may be the value of the target function smaller than a preset value, or the value of the target function within 5 lowest values (or other preset value).

Step 304 includes: determining a target speech waveform unit among the candidate speech waveform unit corresponding to each phoneme in the phoneme sequence using a viterbi algorithm based on the acoustic characteristic corresponding to the determined candidate speech waveform unit and the connection cost function.

In the embodiment, the electronic device may determine a target speech waveform unit among the candidate speech waveform unit corresponding to each phoneme in the phoneme sequence using the viterbi algorithm based on the acoustic characteristic corresponding to the determined candidate speech waveform unit and the connection cost function. Specifically, for each phoneme in the phoneme sequence, the electronic device may determine the value of the connection cost function corresponding to the candidate speech waveform unit corresponding to the phoneme, determine, using a viterbi algorithm, a candidate speech waveform unit corresponding to the phoneme and having a minimum value of a sum of the target cost function and the connection cost function of the phoneme, and determine the candidate speech waveform unit as the target speech waveform unit corresponding to the phoneme. In practice, the viterbi algorithm is a dynamic programming algorithm for seeking a viterbi path that is most likely to produce an observed event sequence. Here, the method for determining a target speech waveform unit using the viterbi algorithm is a well-known technique, which is widely researched and applied at present, and is not repeated any more here.

Step 305 includes: synthesizing the target speech waveform unit corresponding to each phoneme in the phoneme sequence to generate a speech.

In the embodiment, the electronic device may synthesize the target speech waveform unit corresponding to each phoneme in the phoneme sequence to generate the speech. Specifically, the electronic device may synthesize the target speech waveform unit using a waveform concatenation method (e.g., Pitch Synchronous OverLap Add, PSOLA). It should be noted that the waveform concatenation method is widely researched and applied at present, and is not repeated any more here.

As can be seen from FIG. 3, compared with the embodiment corresponding to FIG. 2, the flow 300 of the method for speech synthesis according to the embodiment highlights the determining the target speech waveform unit corresponding to each phoneme using the target cost function and the connection cost function. Therefore, the solution according to the embodiment may further improve the effect of speech synthesis.

Figure 4:
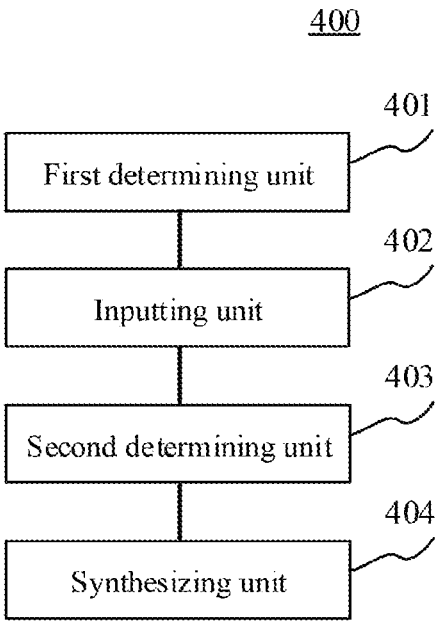
FIG. 4 is a structural schematic diagram of an apparatus for speech synthesis according to an embodiment of the disclosure.

Referring to FIG. 4, as an implementation of the method shown in the above figures, an apparatus for speech synthesis is provided according to an embodiment of the disclosure. The embodiment of the apparatus corresponds to the embodiment of the method shown in FIG. 2, and the apparatus may be specifically applied to a variety of electronic devices.

As shown in FIG. 4, an apparatus 400 for speech synthesis according to the embodiment includes: a first determining unit 401, configured for determining a phoneme sequence of a to-be-processed text; an inputting unit 402, configured for inputting the phoneme sequence into a pre-trained speech model to obtain an acoustic characteristic corresponding to each phoneme in the phoneme sequence, where the speech model is used for characterizing a corresponding relationship between each phoneme in the phoneme sequence and an acoustic characteristic; a second determining unit 403, configured for determining, for each phoneme in the phoneme sequence, at least one speech waveform unit corresponding to the phoneme based on a preset index of phonemes and speech waveform units, and determining a target speech waveform unit of the at least one speech waveform unit based on the acoustic characteristic corresponding to the phoneme and a preset cost function; and a synthesizing unit 404, configured for synthesizing the target speech waveform unit corresponding to each phoneme in the phoneme sequence to generate a speech.

In the embodiment, a corresponding relationship between large amounts of characters and phonemes may be pre-stored in the first determining unit 401. The first determining unit 401 may firstly acquire the to-be-processed text, then determine the phonemes corresponding to characters forming the to-be-processed text based on the pre-stored corresponding relationship between characters and phonemes, thereby successively combining the phonemes corresponding to the characters into the phoneme sequence.

In the embodiment, the inputting unit 402 may input the phoneme sequence into the pre-trained speech model to obtain the acoustic characteristic corresponding to each phoneme in the phoneme sequence, where the speech model may be used for characterizing a corresponding relationship between each phoneme in the phoneme sequence and the acoustic characteristic.

In the embodiment, a preset index of phonemes and speech waveform units may be stored in the second determining unit 403. The index may be used for characterizing a corresponding relationship between phonemes and positions of speech waveform units in a speech library. Therefore, a speech waveform unit corresponding to a phoneme may be found in the speech library based on the index. A given phoneme corresponds to at least one speech waveform unit in the speech library, which usually requires further filtering. For each phoneme in the phoneme sequence, the second determining unit 403 may firstly determine at least one speech waveform unit corresponding to the phoneme based on the index of phonemes and speech waveform units. Then a target speech waveform unit of the at least one speech waveform unit may be determined based on the acquired acoustic characteristic corresponding to the phoneme and a preset cost function.

In the embodiment, the synthesizing unit 404 may synthesize the target speech waveform unit corresponding to each phoneme in the phoneme sequence to generate the speech.

In some optional implementations of the embodiment, the speech model may be an end-to-end neural network. The end-to-end neural network may include a first neural network, an attention model and a second neural network.

In some optional implementations of the embodiment, the apparatus may further include an extracting unit, a third determining unit, and a training unit (not shown in the figure). The extracting unit may be configured for extracting a training sample. The training sample includes a text sample and a speech sample corresponding to the text sample. The third determining unit may be configured for determining a phoneme sequence sample of the text sample and a speech waveform unit forming the speech sample, and extracting an acoustic characteristic from the speech waveform unit forming the speech sample. The training unit may be configured for obtaining the speech model by training using a machine learning method, with the phoneme sequence sample as an input and the extracted acoustic characteristic as an output.

In some optional implementations of the embodiment, the apparatus may further include a fourth determining unit and an establishing unit (not shown in the figure). The fourth determining unit may be configured for determining, for each phoneme in the phoneme sequence sample, a speech waveform unit corresponding to the phoneme based on the acoustic characteristic corresponding to the phoneme. The establishing unit may be configured for establishing the index of phonemes and speech waveform units based on corresponding relationship between each phoneme in the phoneme sequence sample and the speech waveform unit.

In some optional implementations of the embodiment, the cost function may include a target cost function and a connection cost function, the target cost function is used for characterizing a matching degree between the speech waveform unit and the acoustic characteristic, and the connection cost function is used for characterizing a continuity of adjacent speech waveform units.

In some optional implementations of the embodiment, the determining unit 403 may include a first determining module and a second determining module (not shown in the figure). The first determining module may be configured for determining, for each phoneme in the phoneme sequence, at least one speech waveform unit corresponding to the phoneme based on a preset index of phonemes and speech waveform units; using the acoustic characteristic corresponding to the phoneme as a target acoustic characteristic, extracting, for each speech waveform unit of the at least one speech waveform unit, an acoustic characteristic of the speech waveform unit, and determining a value of the target cost function based on the extracted acoustic characteristic and the target acoustic characteristic; and determining the speech waveform unit corresponding to the value of the target function meeting a preset condition as a candidate speech waveform unit corresponding to the phoneme. The second determining module may be configured for determining a target speech waveform unit among the candidate speech waveform unit corresponding to each phoneme in the phoneme sequence using a viterbi algorithm based on the acoustic characteristic corresponding to the determined candidate speech waveform unit and the connection cost function.

In the apparatus according to the embodiment of the disclosure, the inputting unit 402 inputs a phoneme sequence of a to-be-processed text determined by the first determining unit 401 into a pre-trained speech model to obtain an acoustic characteristic corresponding to each phoneme in the phoneme sequence, then the second determining unit 403 determines at least one speech waveform unit corresponding to each phoneme based on a preset index of phonemes and speech waveform units, determines a target speech waveform unit corresponding to the phoneme based on the acoustic characteristic corresponding to the phoneme and a preset cost function, and finally the synthesizing unit 403 synthesizes the target speech waveform unit corresponding to each phoneme to generate a speech, thereby improving the effect and efficiency of speech synthesis without the need of converting acoustic characteristics into speeches via a vocoder, and without the need of manually aligning and segmenting phonemes and speech waveforms.

Figure 5:
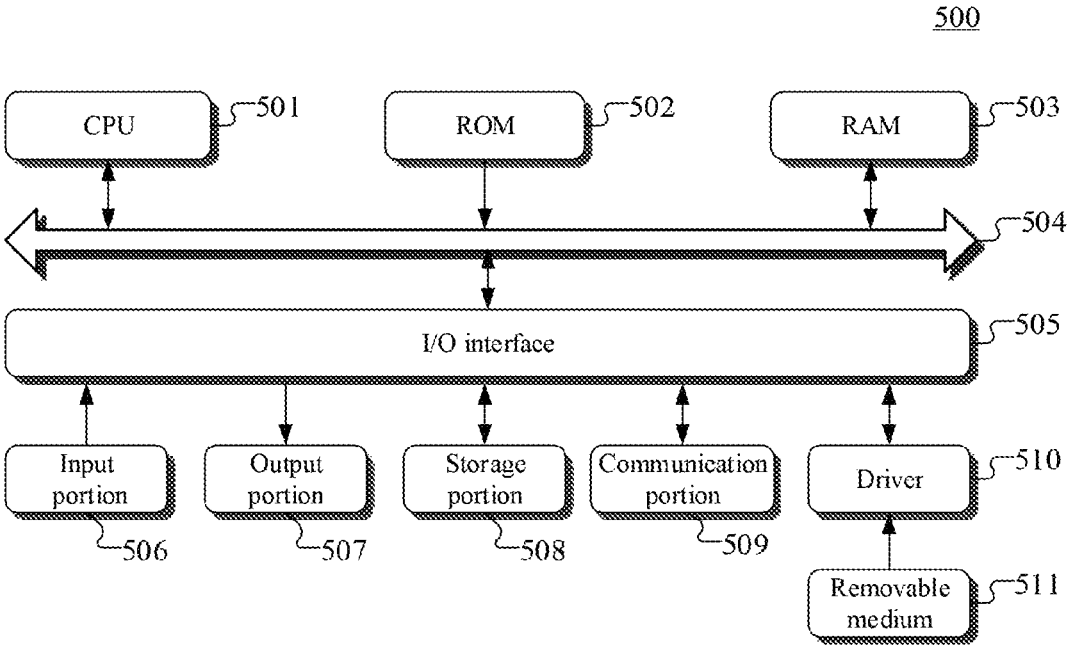
FIG. 5 is a structural schematic diagram of a computer system adapted to implement an electronic device according to an embodiment of the disclosure.

Referring to FIG. 5, a schematic structural diagram of a computer system 500 adapted to implement an electronic device of the embodiments of the present disclosure is shown. The electronic device shown in FIG. 5 is only an example, and is not a limitation to the function and the scope of the embodiments of the disclosure.

As shown in FIG. 5, the computer system 500 includes a central processing unit (CPU) 501, which may execute various appropriate actions and processes in accordance with a program stored in a read-only memory (ROM) 502 or a program loaded into a random access memory (RAM) 503 from a storage portion 508. The RAM 503 also stores various programs and data required by operations of the system 500. The CPU 501, the ROM 502 and the RAM 503 are connected to each other through a bus 504. An input/output (I/O) interface 505 is also connected to the bus 504.

The following components are connected to the I/O interface 505: an input portion 506 including a keyboard, a mouse etc.; an output portion 507 including a cathode ray tube (CRT), a liquid crystal display device (LCD), a speaker etc.; a storage portion 508 including a hard disk and the like; and a communication portion 509 including a network interface card, such as a LAN card and a modem. The communication portion 509 performs communication processes via a network, such as the Internet. A driver 510 is also connected to the I/O interface 505 as required. A removable medium 511, such as a magnetic disk, an optical disk, a magneto-optical disk, and a semiconductor memory, may be installed on the driver 510, to facilitate the retrieval of a computer program from the removable medium 511, and the installation thereof on the storage portion 508 as needed.

In particular, according to embodiments of the present disclosure, the process described above with reference to the flow chart may be implemented in a computer software program. For example, an embodiment of the present disclosure includes a computer program product, which comprises a computer program that is tangibly embedded in a machine-readable medium. The computer program includes program codes for executing the method as illustrated in the flow chart. In such an embodiment, the computer program may be downloaded and installed from a network via the communication portion 509, and/or may be installed from the removable media 511. The computer program, when executed by the central processing unit (CPU) 501, implements the above mentioned functionalities as defined by the methods of the present disclosure. It should be noted that the computer readable medium in the present disclosure may be computer readable signal medium or computer readable storage medium or any combination of the above two. An example of the computer readable storage medium may include, but not limited to: electric, magnetic, optical, electromagnetic, infrared, or semiconductor systems, apparatus, elements, or a combination any of the above. A more specific example of the computer readable storage medium may include but is not limited to: electrical connection with one or more wire, a portable computer disk, a hard disk, a random access memory (RAM), a read only memory (ROM), an erasable programmable read only memory (EPROM or flash memory), a fibre, a portable compact disk read only memory (CD-ROM), an optical memory, a magnet memory or any suitable combination of the above. In the present disclosure, the computer readable storage medium may be any physical medium containing or storing programs which can be used by a command execution system, apparatus or element or incorporated thereto. In the present disclosure, the computer readable signal medium may include data signal in the base band or propagating as parts of a carrier, in which computer readable program codes are carried. The propagating signal may take various forms, including but not limited to: an electromagnetic signal, an optical signal or any suitable combination of the above. The signal medium that can be read by computer may be any computer readable medium except for the computer readable storage medium. The computer readable medium is capable of transmitting, propagating or transferring programs for use by, or used in combination with, a command execution system, apparatus or element. The program codes contained on the computer readable medium may be transmitted with any suitable medium including but not limited to: wireless, wired, optical cable, RF medium etc., or any suitable combination of the above.

The flow charts and block diagrams in the accompanying drawings illustrate architectures, functions and operations that may be implemented according to the systems, methods and computer program products of the various embodiments of the present disclosure. In this regard, each of the blocks in the flow charts or block diagrams may represent a module, a program segment, or a code portion, said module, program segment, or code portion comprising one or more executable instructions for implementing specified logic functions. It should also be noted that, in some alternative implementations, the functions denoted by the blocks may occur in a sequence different from the sequences shown in the figures. For example, any two blocks presented in succession may be executed, substantially in parallel, or they may sometimes be in a reverse sequence, depending on the function involved. It should also be noted that each block in the block diagrams and/or flow charts as well as a combination of blocks may be implemented using a dedicated hardware-based system executing specified functions or operations, or by a combination of a dedicated hardware and computer instruction.

The units involved in the embodiments of the present disclosure may be implemented by means of software or hardware. The described units may also be provided in a processor, for example, described as: a processor, including a first determining unit, an input unit, a second determining unit and a synthesizing unit, where the names of these units do not in some cases constitute a limitation to such units themselves. For example, the first determining unit may also be described as "a unit for a phoneme sequence of a to-be-processed text."

In another aspect, the present disclosure further provides a computer-readable medium. The computer-readable medium may be the computer medium included in the apparatus in the above described embodiments, or a stand-alone computer-readable medium not assembled into the apparatus. The computer-readable medium stores one or more programs. The one or more programs, when executed by a device, cause the device to: determine a phoneme sequence of a to-be-processed text; input the phoneme sequence into a pre-trained speech model to obtain an acoustic characteristic corresponding to each phoneme in the phoneme sequence, where the speech model is used for characterizing a corresponding relationship between the each phoneme in the phoneme sequence and the acoustic characteristic; determine, for the each phoneme in the phoneme sequence, at least one speech waveform unit corresponding to the each phoneme based on a preset index of phonemes and speech waveform units, and determining a target speech waveform unit of the at least one speech waveform unit based on the acoustic characteristic corresponding to the each phoneme and a preset cost function; and synthesize the target speech waveform unit corresponding to the each phoneme in the phoneme sequence to generate a speech.

The above description only provides an explanation of the preferred embodiments of the present disclosure and the technical principles used. It should be appreciated by those skilled in the art that the inventive scope of the present disclosure is not limited to the technical solutions formed by the particular combinations of the above-described technical features. The inventive scope should also cover other technical solutions formed by any combinations of the above-described technical features or equivalent features thereof without departing from the concept of the disclosure. Technical schemes formed by the above-described features being interchanged with, but not limited to, technical features with similar functions disclosed in the present disclosure are examples.

What is claimed is:

1. A method for speech synthesis, comprising:

determining a phoneme sequence of a to-be-processed text;

inputting the phoneme sequence into a pre-trained speech model to obtain an acoustic characteristic corresponding to each phoneme in the phoneme sequence, wherein the speech model is used for characterizing a corresponding relationship between the each phoneme in the phoneme sequence and the acoustic characteristic;

determining, for the each phoneme in the phoneme sequence, at least one speech waveform unit corresponding to the each phoneme based on a preset index of phonemes and speech waveform units, and determining a target speech waveform unit of the at least one speech waveform unit based on the acoustic characteristic corresponding to the each phoneme and a preset cost function; and synthesizing the target speech waveform unit corresponding to the each phoneme in the phoneme sequence to generate a speech.

2. The method according to claim 1, wherein the speech model is an end-to-end neural network, and the end-to-end neural network comprising a first neural network, an attention model and a second neural network.

3. The method according to claim 1, wherein the speech model is obtained by following training:

extracting a training sample, the training sample comprising a text sample and a speech sample corresponding to the text sample;

determining a phoneme sequence sample of the text sample and a speech waveform unit forming the speech sample, and extracting an acoustic characteristic from the speech waveform unit forming the speech sample; and training, using a machine learning method, with the phoneme sequence sample as an input and the extracted acoustic characteristic as an output, to obtain the speech model.

4. The method according to claim 3, wherein the preset index of phonemes and speech waveform units is obtained by following:

determining, for each phoneme in the phoneme sequence sample, a speech waveform unit corresponding to the each phoneme based on the acoustic characteristic corresponding to the each phoneme; and establishing the index of phonemes and speech waveform units based on a corresponding relationship between the each phoneme in the phoneme sequence sample and the speech waveform unit.

5. The method according to claim 1, wherein the cost function comprises a target cost function and a connection cost function, the target cost function is used for characterizing a matching degree between the speech waveform unit and the acoustic characteristic, and the connection cost function is used for characterizing a continuity of adjacent speech waveform units.

6. The method according to claim 5, wherein the determining, for the each phoneme in the phoneme sequence, at least one speech waveform unit corresponding to the each phoneme based on the preset index of phonemes and speech waveform units, and determining a target speech waveform unit of the at least one speech waveform unit based on the acoustic characteristic corresponding to the each phoneme and a preset cost function comprises:

determining, for the each phoneme in the phoneme sequence, at least one speech waveform unit corresponding to the each phoneme based on the preset index of phonemes and speech waveform units; using the acoustic characteristic corresponding to the each phoneme as a target acoustic characteristic, extracting, for each speech waveform unit of the at least one speech waveform unit, an acoustic characteristic of the each speech waveform unit, and determining a value of the target cost function based on the extracted acoustic characteristic and the target acoustic characteristic; and determining the speech waveform unit corresponding to the value of the target function meeting a preset condition as a candidate speech waveform unit corresponding to the each phoneme; and determining a target speech waveform unit among the candidate speech waveform unit corresponding to the each phoneme in the phoneme sequence using a viterbi algorithm based on the acoustic characteristic corresponding to the determined candidate speech waveform unit and the connection cost function.

7. An apparatus for speech synthesis, comprising:

at least one processor; and a memory storing instructions, the instructions when executed by the at least one processor, cause the at least one processor to perform operations, the operations comprising:

determining a phoneme sequence of a to-be-processed text;

inputting the phoneme sequence into a pre-trained speech model to obtain an acoustic characteristic corresponding to each phoneme in the phoneme sequence, wherein the speech model is used for characterizing a corresponding relationship between the each phoneme in the phoneme sequence and the acoustic characteristic;

determining, for the each phoneme in the phoneme sequence, at least one speech waveform unit corresponding to the each phoneme based on a preset index of phonemes and speech waveform units, and determining a target speech waveform unit of the at least one speech waveform unit based on the acoustic characteristic corresponding to the each phoneme and a preset cost function; and synthesizing the target speech waveform unit corresponding to the each phoneme in the phoneme sequence to generate a speech.

8. The apparatus according to claim 7, wherein the speech model is an end-to-end neural network, and the end-to-end neural network comprising a first neural network, an attention model and a second neural network.

9. The apparatus according to claim 7, wherein the operations further comprise:

extracting a training sample, the training sample comprising a text sample and a speech sample corresponding to the text sample;

determining a phoneme sequence sample of the text sample and a speech waveform unit forming the speech sample, and extracting an acoustic characteristic from the speech waveform unit forming the speech sample; and training, using a machine learning method, with the phoneme sequence sample as an input and the extracted acoustic characteristic as an output, to obtain the speech model.

10. The apparatus according to claim 9, the operations further comprise:

determining, for each phoneme in the phoneme sequence sample, a speech waveform unit corresponding to the each phoneme based on the acoustic characteristic corresponding to the each phoneme; and establishing the index of phonemes and speech waveform units based on a corresponding relationship between the each phoneme in the phoneme sequence sample and the speech waveform unit.

11. The apparatus according to claim 7, wherein the cost function comprises a target cost function and a connection cost function, the target cost function is used for characterizing a matching degree between the speech waveform unit and the acoustic characteristic, and the connection cost function is used for characterizing a continuity of adjacent speech waveform units.

12. The apparatus according to claim 11, wherein the determining, for the each phoneme in the phoneme sequence, at least one speech waveform unit corresponding to the each phoneme based on the preset index of phonemes and speech waveform units, and determining a target speech waveform unit of the at least one speech waveform unit based on the acoustic characteristic corresponding to the each phoneme and a preset cost function comprises:

determining, for the each phoneme in the phoneme sequence, at least one speech waveform unit corresponding to the each phoneme based on the preset index of phonemes and speech waveform units; using the acoustic characteristic corresponding to the each phoneme as a target acoustic characteristic, extracting, for each speech waveform unit of the at least one speech waveform unit, an acoustic characteristic of the each speech waveform unit, and determining a value of the target cost function based on the extracted acoustic characteristic and the target acoustic characteristic; and determining the speech waveform unit corresponding to the value of the target function meeting a preset condition as a candidate speech waveform unit corresponding to the each phoneme; and determining a target speech waveform unit among the candidate speech waveform unit corresponding to the each phoneme in the phoneme sequence using a viterbi algorithm based on the acoustic characteristic corresponding to the determined candidate speech waveform unit and the connection cost function.

13. A non-transitory computer medium, storing a computer program, wherein the program, when executed by a processor, causes the processor to perform operations, the operations comprising:

determining a phoneme sequence of a to-be-processed text;

inputting the phoneme sequence into a pre-trained speech model to obtain an acoustic characteristic corresponding to each phoneme in the phoneme sequence, wherein the speech model is used for characterizing a corresponding relationship between the each phoneme in the phoneme sequence and the acoustic characteristic;

determining, for the each phoneme in the phoneme sequence, at least one speech waveform unit corresponding to the each phoneme based on a preset index of phonemes and speech waveform units, and determining a target speech waveform unit of the at least one speech waveform unit based on the acoustic characteristic corresponding to the each phoneme and a preset cost function; and synthesizing the target speech waveform unit corresponding to the each phoneme in the phoneme sequence to generate a speech.

* * * * *